US005105492A

United States Patent [19]

Karpinski

[11] Patent Number: 5,105,492

[45] Date of Patent: Apr. 21, 1992

[54] ROD AND BRACKET ASSEMBLY

[76] Inventor: Vivian L. Karpinski, 4607 Madison St., New Port Richey, Fla. 34652

[21] Appl. No.: 736,599

[22] Filed: Jul. 26, 1991

[51] Int. Cl.[5] ..... A47C 21/00

[52] U.S. Cl. ..... 5/493; 5/451; 5/658

[58] Field of Search ..... 5/493, 400, 451, 280, 5/508; 160/387, 392, 399; 248/74.2, 316.7

[56] References Cited

U.S. PATENT DOCUMENTS

| | | | |
|---|---|---|---|
| 710,477 | 10/1902 | Littel | 5/493 X |
| 1,270,524 | 6/1918 | Kane | 5/493 |
| 3,194,524 | 7/1965 | Trumbull | 248/74.2 X |
| 3,317,167 | 5/1967 | Becker et al. | 248/316.7 X |
| 4,042,198 | 8/1972 | Takeuchi | 248/74.2 X |
| 4,186,452 | 2/1980 | Underwood | 5/400 X |
| 4,228,980 | 10/1980 | Beauchamp et al. | 5/493 X |
| 4,860,398 | 8/1989 | Karpinski | 5/493 |

FOREIGN PATENT DOCUMENTS

| | | | |
|---|---|---|---|
| 12142 | of 1903 | United Kingdom | 5/493 |
| 14123 | of 1913 | United Kingdom | 5/493 |

*Primary Examiner*—Michael F. Trettel
*Attorney, Agent, or Firm*—Dominik, Stein, Saccocio, Reese, Colitz & VanDerWall

[57] ABSTRACT

A hardside waterbed over which bedding is to be placed; a rod and bracket assembly secured to the waterbed, such rod and bracket assembly including rods, and a plurality of brackets secured to the waterbed by their upper extents with upwardly projecting resilient fingers of a size as to receive the rods around the opposite sides and bottom end of the waterbed, and a bed skirt having means at its upper end for coupling the bed skirt to the rod means.

11 Claims, 2 Drawing Sheets

ROD AND BRACKET ASSEMBLY

BACKGROUND OF THE INVENTION

1. Summary of the Invention

This invention relates to improved rod and bracket assemblies for bed skirts often called dust ruffles and, more particularly, to a hardside waterbed, a bed skirt and a rod and bracket assembly having a plurality of vertically extending, laterally spaced brackets coupled to the bottom of the hardside waterbed with horizontally extending rods placed into and retained by the brackets to support the bed skirt.

2. Description of the Background Art

In the field of bed skirts and their supporting hardware, it is the common practice to position a flat sheet-like member or platform beneath a mattress and above a box spring supported on slats of a bed frame. The platform is of a size to be peripherally co-extensive with the box spring and mattress. From the two sides and foot end of the platform, cloth depends in a color and fabric coordinated with other parts of the bedding or room. The depending fabric preferably includes tucks or shirring permanently stitched to the platform. Because of its extensive size and shirring, the stitching of the depending cloth to the platform is a burdensome task.

In addition to fabrication problems, the placement of a skirt in position between a box spring and mattress and its removal, whether for cleaning or replacement purposes, is also difficult, a two-person job requiring the removal of the mattress from the box spring and its replacement. Consequently, skirt cleaning or changing is frequently done less often than it should be. Further, any unnecessary movement of the box spring or mattress, as during sleeping or making the bed, may laterally displace the previously positioned platform to render the hem of the skirt uneven requiring, in turn, readjustment of the skirt.

The problems associated with advanced rod and bracket assemblies for bed skirts are rendered complicated when such technology is applied to hardside waterbeds. Hardside waterbeds include a rigid frame structure with a horizontal bottom and vertical walls and a water filled bladder supported therein. The entire frame may be supported on an additional rigid structure for appropriate elevation. No techniques are known for maintaining bed skirts at a proper elevational location on such hardside waterbeds.

The prior art discloses a large number of techniques for holding a bed skirt in place. Consider British Patent Numbers 13,369 to Brownlow and 20,213 to Cluskey as well as Littell U.S. Pat. No. 710,477. These patents disclose bed skirts supported on rods secured to a metallic frame in an older form of bed wherein the frame is located at the bottom of the box spring location. Further, Richardson U.S. Pat. No. 264,758 and Higley U.S. Pat. No. 674,609 disclose complex mechanisms for supporting a removable bed skirt with such mechanisms including a plurality of parts connectable to the bed frame members. In addition, Blake U.S. Pat. No. 210,084 and Beauchamp U.S. Pat. No. 4,228,980 disclose bracket arrangements for supporting cloth material depending therefrom but for use in the curtain arts rather than the bedding arts.

Lastly, a variety of prior art patents disclose various techniques for maintaining fabric components including bed skirts at a proper elevational orientation. Such patents include Lehr U.S. Pat. No. 959,763; Woodford U.S. Pat. No. 2,769,989; Johnson U.S. Pat. No. 4,100,632; and Whitfield U.S. Pat. No. 4,716,608. Additional patents of interest are very old patents issued in the United Kingdom as U.K. Patent Numbers 8719; 12142; and 142213.

As illustrated in a great number of prior patents as well as commercial devices, efforts are continuously being made in an attempt to improve bed skirts and their associated hardware whereby yard good material may be conveniently placed and removed from adjacent to the lower portions of hardside waterbeds. None of these previous efforts, however, provides the benefits attendant with the present invention. Additionally, prior art dust ruffles do not suggest the present inventive combination of component elements arranged and configured as disclosed and claimed herein. The present invention achieves its intended purposes, objectives and advantages over the prior art devices through a new, useful and unobvious combination of component elements, with the use of a minimum number of functioning parts, at a reasonable cost to fabricate, and by employing only readily available materials.

Therefore, it is an object of the present invention to provide a hardside waterbed over which bedding is to be placed; a rod and bracket assembly secured to the waterbed, such rod and bracket assembly including rods, and a plurality of brackets secured to the waterbed by their upper extents with upwardly projecting resilient fingers of a size as to receive the rods around the opposite sides and bottom end of the waterbed, and a bed skirt having means at its upper end for coupling the bed skirt to the rod means.

It is another object of this invention to secure brackets and rods with respect to a hardside waterbed to allow for the convenient placement and removal of bed skirts.

It is a further object of the instant invention to simplify the fabrication of shirred dust ruffles Lastly, it is an object of the subject invention to retain bed skirts in proper orientation with respect to beds regardless of movement of the beds or its bedding.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing this invention, this invention comprises a hardside waterbed over which bedding is to be placed; a rod and bracket assembly secured to the waterbed, such rod and bracket assembly including rods, and a plurality of brackets secured to the waterbed by their upper extents with upwardly projecting resilient fingers of a size as to receive the rods around the opposite sides and bottom end of the waterbed, and a bed skirt having means at its upper end for coupling the bed skirt to the rod means.

The bed skirt extends downwardly from the rods a distance equal to the height of the support structure supporting the waterbed. The rods are coupled with respect to each other in a U-shaped configuration for being located along the sides and bottom edge of the waterbed and are separable with respect to each other to thereby allow rods of different sizes to be coupled with respect to each other to accommodate their use in association with waterbeds of different sizes. The combination further includes stoppers removably positioned on the ends of the rods adjacent the head end of the waterbed to preclude inadvertent removal of the bed skirt from the rods.

The invention may also be incorporated into an improved dust ruffle comprising, in combination, a quantity of yard good material having a casing at its upper edge; a plurality of brackets having resilient fingers at their intermediate extents and attachable at their upper ends to a waterbed; and supporting rods removably received in the resilient fingers of the brackets receiving the casing of the material.

The casing is formed by stitches along the upper free end of the yard good material and along a line of the yard good material thereadjacent. The resilient fingers extend upwardly to allow the rods to be supported therein by gravity and the resilience of the fingers but the resilience of the fingers allows the removal of the rods from the brackets by lifting the rods upwardly against gravity and the resilient retaining force of the fingers. The yard good material hangs from the rods along the major extent of the rods but depends from the upper ends of the fingers at locations adjacent the fingers.

The invention may also be incorporated into hardware for being secured to the lower edge of the frame of a hardside waterbed and for supporting a bed skirt, the hardware including a plurality of generally horizontally disposed rod means constituting the upper extent of the hardware each rod means positionable along one edge of the waterbed; and a plurality of generally vertically disposed bracket means, each comprising a vertical section positionable parallel with but beneath a horizontal lower surface of the waterbed and having aperture means in their upper ends for effecting their coupling to the underside of the waterbed, wherein the upper extents of the bracket means are formed as a plurality of resilient fingers in opposed relationship and presenting a generally circular cross-sectional shape conforming with the cross-sectional shape of the rod means to be removably supported thereby Each bracket means includes a horizontal section positionable flush with the lower surface of the waterbed. The resilient fingers are in opposed interleafed relationship.

Lastly, the invention may be incorporated into the combination of a bed over which bedding is to be placed; a rod and bracket assembly secured to the bed, such rod and bracket assembly including rods formed of pluralities of interconnected shorter tubular rods with bent corner rods connecting such pluralities; and a plurality of brackets secured to the bed with upwardly projecting resilient fingers of a size as to receive the rods around the opposite sides and bottom end of the waterbed; and a bed skirt having means at its upper end for coupling the bed skirt to the rod means.

The corner rods are solid in cross section. Each plurality is made up of rods of different diameters which fit one inside the other. At least one of the rods is swedged onto a corner rod. The combination further includes finned fasteners coupled to the end of two of the rods.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
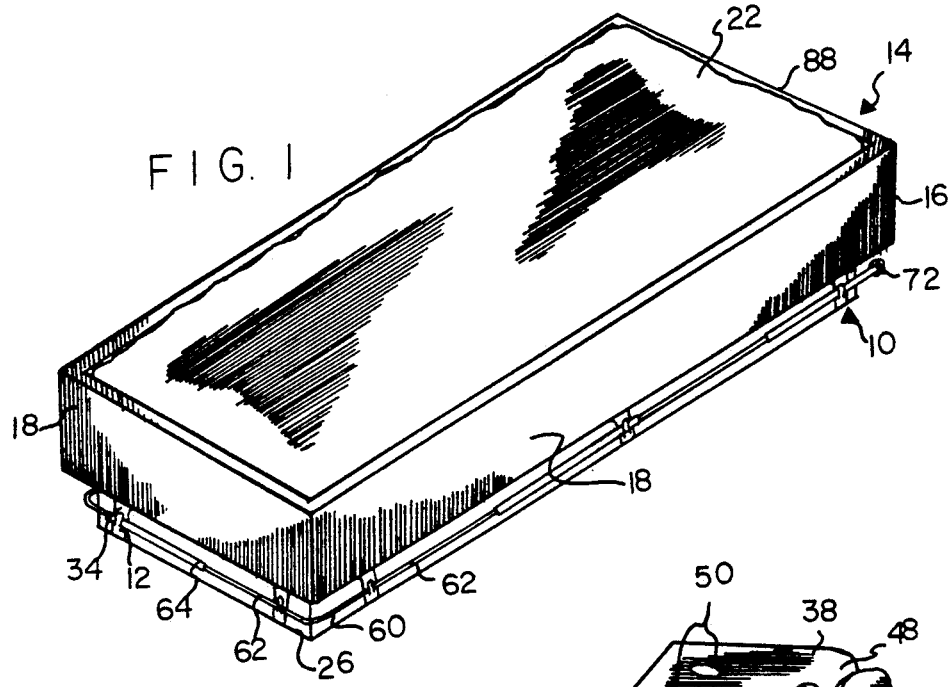
FIG. 1 is a perspective illustration of a hardside waterbed provided with the bracket and rod assembly for supporting a bed skirt constructed in accordance with the principles of the present invention.

With reference to FIG. 1, the present invention is shown as a kit of rods 10 and a plurality of associated brackets 12 in combination with a hardside waterbed 14. Hardside waterbeds are characterized by a rigid frame 16 of wood or the like having a lower planar sheet 17 and upstanding side walls 18 and an open top. Positioned within the structure of the top is a water impervious bladder 20 in which water 22 is provided to generate an upper surface for sleeping which is essentially at a common elevational level with the upper edge of the side walls. A lower rigid support structure 26, as of wood, is located beneath the primary support structure interior of the side walls for thereby providing a proper elevational orientation.

Figure 4:
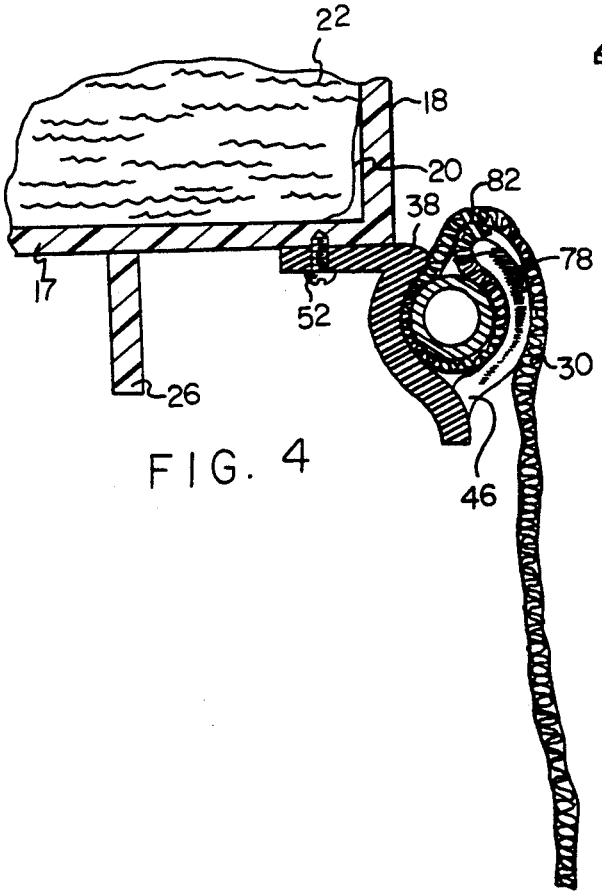
FIG. 4 is a sectional view of one rod and supporting bracket as shown in FIG. 1 and also including a portion of the bed skirt positioned on the rod.
Figure 3:
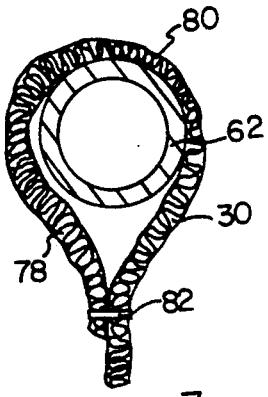
FIG. 3 is a sectional view of one rod as shown in FIG. 1 and also including a portion of the bed skirt positioned on the rod.
Figure 5:
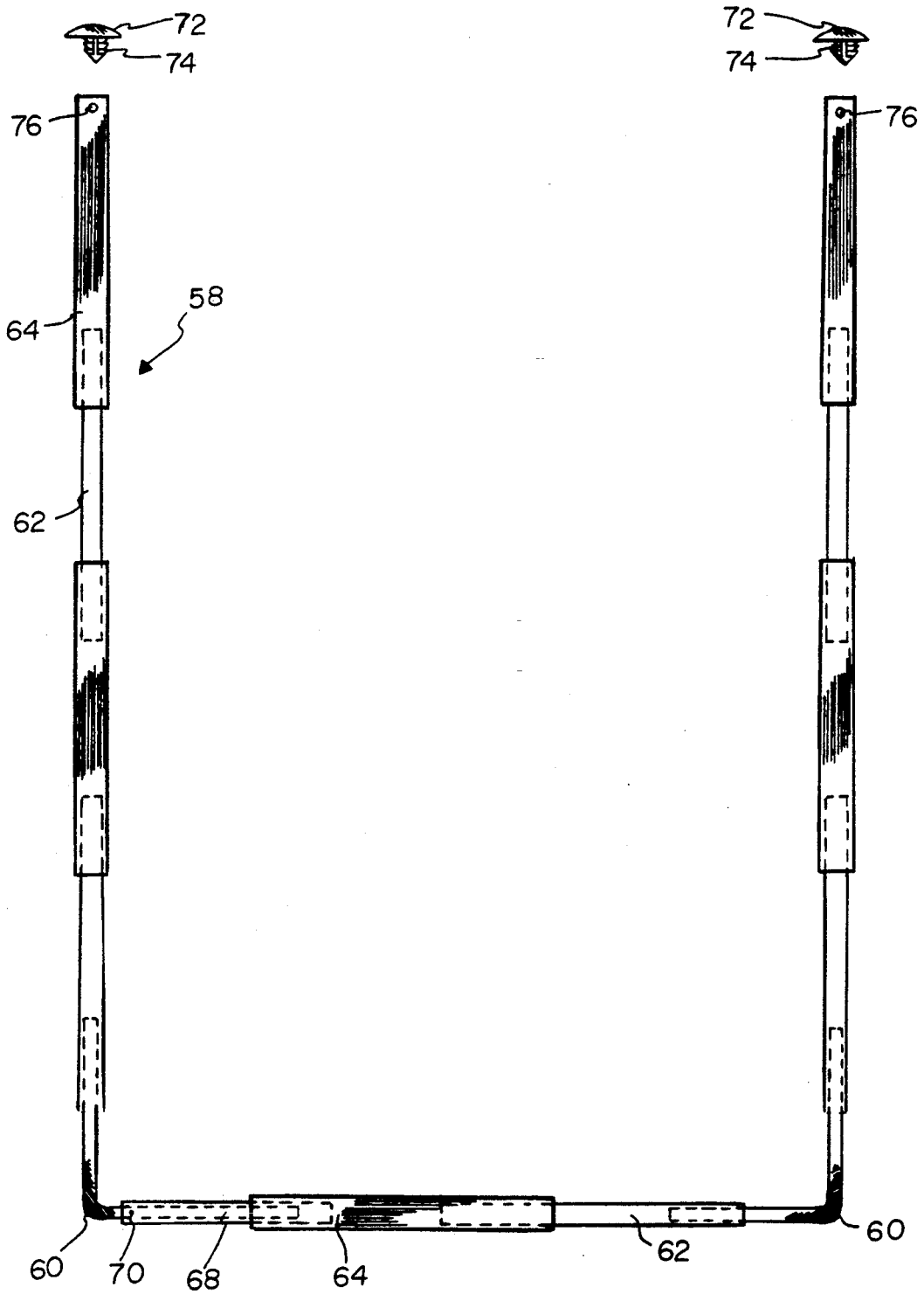
FIG. 5 is a plan view of the rod assembly as shown in FIGS. 1, 3 and 4.

FIGS. 3 and 4 illustrate yard good material 30 operatively coupled therewith. The rod and bracket assembly 34 is attached to a wooden frame 16 in the lower portion of the frame above the lower support 26 and supports in proper position the yard good material 30 as a bed skirt, often called a dust ruffle.

Figure 2:
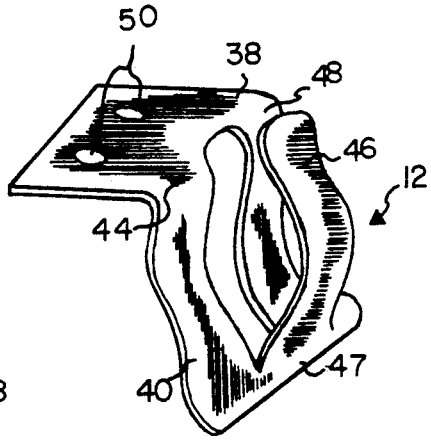
FIG. 2 is a perspective illustration of one of the rod supporting brackets as shown in FIG. 1.

As can be clearly seen in the drawings, each bracket 12 comprises a flat horizontally positionable plate 38 coupled to a vertically positionable face 40 which terminates in downwardly extending free ends 42. The free ends 42 include a plurality of fingers or prongs 44, 46 and 48, three in the disclosed embodiment, shaped to form grooves in a generally circular shape. The fingers or prongs 44, 46 and 48 are upwardly directed and resilient for releasably supporting the rods 10 of a kit. As can be seen in FIG. 2, the upwardly extending central finger 46 and associated fingers 44 and 48 are in an interleafed relationship with two spaced fingers 44 and 48 on the opposite side thereof. Holes 50 at the center of the horizontal plate 38 of each bracket 12 accommodate screws 52 for securement into the wooden frame 16 normally found at the lower portion of modern waterbeds 14. The horizontal plate 38 of each bracket 12 is set flush under the sheet 17 with the back of its vertical face 40 generally parallel with but between the sides of the frame 54 so that the fingers 44, 46 and 48 extend upwardly beneath the frame 54. The upper ends of the brackets 12 terminate alongside the lower edge of the frame.

For hardside waterbeds, the corners of the frame and support structure are sharper, more rectangular than the broad curve of softside waterbeds and conventional box springs and mattresses. In order to accommodate such difference, the corners of the rod assembly 58 at the foot end of the bed are formed with bent corner rods 60 of a solid material. This is necessitated since the larger tubular corner of the prior devices would be incapable of such sharp bends. The sides and foot end of the bed are then provided with tubular rods or tubes 62 and 64. While in the optimum condition a single tube at each linear extent would work, it has been found that the use of such single tubes is inconvenient for handling and shipping. Thinner tubes 62 and thicker tubes 64 are slidingly joined together to give the functional effect of the single longer tube.

Across the foot end of the bed two tube segments are utilized. One of the tubes 62 would be of the smaller diameter, the other tube 64 of the larger diameter. The smaller diameter tube 62 would be fitted over one end of a corner rod 60 and its other end would be located within the adjacent end of the larger tube 64. The larger tube 64 would be fitted over the end of the adjacent solid corner rod 60. But since such an arrangement would create excess play therebetween, a small length of adapter tube 68 of a diameter equal to the smaller tube is swedged permanently onto the adjacent corner of the solid corner rod 60 through a dimple arrangement 70. The tubes 62 and 64, one larger, one smaller, are located one within the other with the opposite end of the smaller tube over its adjacent end of the solid corner rod 60 and with the opposite end of the larger tube slidably received over the short adapter tube 68.

Similarly, along the sides of the bed extending in parallel relationship are four tubes on each bed side. Two such tubes 62 are essentially the same as the smaller diameter tubes at the foot end and two such tubes 64 are essentially the same as the larger diameter tubes at the foot end. The ends of the smaller tubes are placed over the parallel ends of the solid corner rods 60 with the remote ends of the smaller tubes 62 receiving the adjacent ends of the adjacent larger tubes 64. Another pair of larger and smaller tubes 64, 62 are then placed in succession at the sides of the bed along the entire length thereof. The opened ends of the larger tubes 64 are then fitted with finned fasteners 72, each having a longitudinal slot 74. Each fastener 72 is placed with its slot 74 in alignment with an internal dimple 76 on the end of the adjacent larger tube 64. It is then inserted and then provided with a quarter turn in a clockwise direction for locking. Such finned fasteners are conventional in the art but constitute the most preferred way to effect such coupling.

The upward positioning of the fingers of the brackets is such that the force of gravity will support the rods in proper position within the brackets adjacent the lower edge of the waterbed frame. In addition, by constructing the fingers resilient and partially circular in shape, conforming to the cross-sectional shape of the rods, the resilience of the fingers will further retain the rods in proper position. The resilience of the fingers is such, however, that upward movement of the rods will effect separation of the fingers and allow for the removal of the rods from the brackets for their replacement therein.

The visible part of the bed skirt or dust ruffle is the yard good material 30 adapted to be supported on the tubes and rods which together couple to form the U-shaped assembly of a common cross-sectional diameter. The material is of a length equal to, but preferably greater than, the lengths of the tubes and solid rods when coupled together and supported by the brackets By constructing the material of the greater length, up to fifty percent (50%) greater than the length of the U-shaped structure in the preferred mode, the material may be eventually gathered together along its length to form tucks or a shirred effect which is more pleasing in appearance.

A loop or casing 78 is formed into the upper edge 80 of the yard good material by a line of stitching 82. The casing is of such size as to easily receive the tubes and rods. This size relationship allows for the shirring of the bed skirt as well as the receipt of the tubes and rods and material into the resilient upper free ends at the upper edges of the brackets 12.

As can be seen with particular reference to FIG. 3, the yard good material hangs from the rods for the majority of the extent of the material. In the region of the brackets, however, the fabric supported on the rods will be tucked into the region within the fingers of the brackets and will, thereby, depend from the top of the brackets. When sufficient material is utilized and shirred, no noticeable raising of the fabric adjacent the brackets will be visible to detract from the preferred appearance of the bed skirt.

The length of the material hanging from the tubes and rods is preferably of a length equal to the height from the floor up to the lower edge of the sidewalls. In this manner the material will effectively hide the area therebeneath the entire way to the floor. The height of the material is such that when standard bedding, in the nature of sheets or a color-coordinated comforter, is placed on the bed, the lower edges thereof will slightly overlap the material of the bed skirt to present a layered look for optimum appearance.

When the bed skirt has been installed on the tube assembly and the tube assembly has been snapped onto the brackets, the finned fasteners are pushed into the ends of the tubes at the head end 88 of the bed and given a 90 degree turn to lock in place and thereby prevent the bed skirt from slipping off the ends of the tubes. Thus it can be seen that the bed skirt rod assembly, whether it is made of wood, metal, plastic or any other suitable material or combination of materials, provides a simple and effective device for mounting preselected yard good material thereon resulting in a bed skirt or dust ruffle which is simple to fabricate, which always retains its position and which is easy to remove and replace.

During fabrication, the bracket is bent 90 degrees near the upper edge to form the horizontal section and holes are formed therein. The vertical section is cut in an inverted U-shaped configuration to form the fingers. The central finger is bent into an arcuate configuration while the other fingers on opposite sides of the central finger are bent into an oppositely disposed arcuate configuration to form a region for receiving a rod portion. Lastly, the upper edge of the central finger is bent outwardly to facilitate separating the fingers and inserting the rod. The sequence of these steps may be done in various sequences for convenience.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. In combination:

a hardside waterbed over which bedding is to be placed the hardside waterbed included a support structure with an elevated peripheral ledge having a downwardly facing surface;

a rod and bracket assembly secured to the waterbed at the surface, such rod and bracket assembly including rods, and a plurality of brackets having upper extents secured to the waterbed, each bracket having upwardly projecting resilient fingers of a size as to receive the rods around at least the majority of the periphery of the waterbed, each bracket having a laterally disposed portion with a vertical aperture located offset from the upper extent of the resilient fingers to effect attachment to the surface; and a bed skirt having means at its upper end for coupling the bed skirt to the rod means.

2. The combination as set forth in claim 1 wherein the bed skirt extends downwardly from the rods a distance equal to the height of the support structure supporting the waterbed.

3. The combination as set forth in claim 2 wherein the rods are coupled with respect to each other in a U-shaped configuration for being located along the sides and bottom edge of the waterbed and are separable with respect to each other to thereby allow rods of different sizes to be coupled with respect to each other to accommodate their use in association with waterbeds of different sizes.

4. The combination as set forth in claim 3 and further including stoppers removably positioned on the ends of the rods adjacent the head end of the waterbed to preclude inadvertent removal of the bed skirt from the rods.

5. The combination as set forth in claim 1 wherein the rods include corner rods which are solid in cross section.

6. The combination as set forth in claim 5 wherein the rods include a plurality made up of linear rods of different diameters which fit one inside the other.

7. The combination as set forth in claim 6 wherein at least one of hte rods is swedged onto a corner rod.

8. The combination as set forth in claim 7 and further including finned fasteners coupled to the end of two of the rods.

9. Hardware for being secured to the lower edge of the frame of a hardside waterbed and for supporting a bed skirt, the hardware having an upper and lower extent and including:

a plurality of generally horizontally dipsosed rod means constituting the upper extent of the hardware with each rod means positionable along one edge of the waterbed; and a plurality of generally vertically disposed bracket means, each bracket means comprising a vertical section positionable adjacent with but beneath a horizontal lower surface of the waterbed and having aperture means at an upper end for coupling the bracket means to the horizontal lower surface of the waterbed, wherein the vertical section of each bracket means is formed as a plurality of resilient fingers in opposed relationship and presenting a generally circular cross-sectional shape conforming with the cross-sectional shape of the rod means, said rod means being removably supported by the resilient fingers.

10. The hardware as set forth in claim 9 wherein each bracket means includes a horizontal section positionable flush with the lower surface of the waterbed.

11. The hardware as set forth in claim 10 wherein the resilient fingers are in opposed interleafed relationship.

* * * * *